United States Patent [19]

Lerner et al.

[11] Patent Number: 4,750,586

[45] Date of Patent: Jun. 14, 1988

[54] MULTI-TUBULAR ACOUSTIC BAFFLE SYSTEM

[75] Inventors: Lawrence Lerner, Beverly Hills; Stephen P. Diskin, Los Angeles, both of Calif.

[73] Assignee: Mega/Erg Inc., Beverly Hills, Calif.

[21] Appl. No.: 907,579

[22] Filed: Sep. 15, 1986

[51] Int. Cl.[4] ..... E04B 1/82

[52] U.S. Cl. ..... 181/295; 181/30; 181/284; 181/287; 181/290; 181/294

[58] Field of Search ..... 181/30, 210, 284, 287, 181/295, DIG. 1, 290, 294

[56] References Cited

U.S. PATENT DOCUMENTS

| | | | |
|---|---|---|---|
| 1,825,465 | 9/1931 | MacDonald | 181/30 |
| 3,049,190 | 8/1962 | Coffman | 181/287 |
| 4,570,748 | 2/1986 | Ghibu et al. | 181/295 X |

*Primary Examiner*—Benjamin R. Fuller
*Attorney, Agent, or Firm*—Charles H. Schwartz; Ellsworth R. Roston

[57] ABSTRACT

A multi-tubular acoustic absorber panel system suited particularly for use in open office environments or workspaces with unwanted echoes, excessive noise, or the need for enhanced acoustic privacy. The basic components of the system are a series of sound absorbent tubular members and a structure for holding the members in an array, creating a baffle which can be attached to wall or ceiling surfaces or, in the preferred embodiment, to a manufactured office partition. When installed, the system creates a lightweight, adaptable, highly absorbent enclosure, capable of significant reduction in unwanted noise and increase in acoustic privacy.

5 Claims, 2 Drawing Sheets

MULTI-TUBULAR ACOUSTIC BAFFLE SYSTEM

BACKGROUND OF THE INVENTION

The open-plan office, while providing a desireable working environment, brings with it the need for acoustic controls. The majority of such offices are furnished with workstations built from manufactured partitions in various modular heights and widths, assembled into useable arrangements. These partitions may provide some amount of visual privacy, but they do not usually furnish much acoustic privacy. Often, both partition surfaces and ceiling surfaces are covered with or made from sound absorbing material, although this solution is frequently inadequate, hence the need for additional sound absorptive surfaces and enclosures. Modern acoustical principles suggest that additional material be located strategically at or near the source of annoying sound. Also, such additional sound absorbers should give the user a psycho-acoustical sense of enclosure, privacy and comfort in additon to an actual reduction in the transmission of sound via reflection to adjacent workspaces.

At present, the installation of additional acoustically absorptive material in a workspace involves expensive labor and a physical alteration of existing surfaces; no direct method of strategically locating individual baffles is in common use. The present invention intends to address all of the foregoing issues.

In its preferred embodiment, the invention consists of lengths of sound absorbing tubular material (such as flexible urethane or the like) attached in a frame or structure, adjacent along their length to create a planar form with a "scalloped" cross-section. This presents a surface area 57% greater than if the surface were flat, thereby enhancing absorbing efficiency. A variety of hardware is used to hold the tubes to structural members and, in the preferred form of the device, to anchor the tubular assembly directly to slotted standards which are virtually universally installed in manufactured office partitions. Other configurations of the device use alternate hardware for wall mount, table mount, ceiling suspension or other attachment to horizontal or vertical surfaces. Tubular sections are easy to fabricate and assemble, and are lightweight when appropriate flexible absorptive foams are used. This permits simple mounting and location in a large variety of situations.

SUMMARY OF THE INVENTION

The present invention is meant to provide a multi-tubular acoustic baffle system which is easily fabricated and assembled, lightweight, efficiently shaped to absorb sound and specifically adaptable for mounting to manufactured office workstation partitions. To achieve this, the device is designed to consist of 3 elements—tubular sound absorbers which may be made in a variety of lengths, structural supports which array and firmly hold in basically planar form, a multiplicity of tubular absorbing elements, and a variety of hardware for attaching the resulting assembled absorber to any room surface, work surface, or, in the preferred embodiment, to manufactured workstation partitions.

The primary object of the invention is that it be an effective acoustic baffle for enhancing privacy and controlling noise in an open-office workstation.

Another object of the invention is an acoustic baffle specifically shaped and adapted to attach directly to manufactured workstation partitions using built-in slotted standards within the partition, and suitable clip-in connectors which are common to most workstation partition system accessories.

Another object of the invention is that it be easily installed by workstation users or maintenance personel rather than by professional skilled installers.

Another object of the invention is that it employ modular sound absorbing elements which can be cut to length to fit various partition widths.

Another object of the invention is that it be made of lightweight material so that it can be safely mounted to free standing partitions without excessive structural bracing.

Another object of the invention is that it be shaped efficiently to absorb and contain sound, and be positionable close to noise sources and strategically located to provide acoustic privacy and absorption.

Another object of the invention is that it can be used apart from manufactured partitions and be adaptable to any wall, ceiling, table top or any other surface or position so to be rendered useful in absorption of unwanted sound.

Another object of the invention is that it can be easily removeable for relocation and easily demountable for compact shipping or storage.

DETAILED DESCRIPTION OF DRAWINGS

The present invention is described in several embodiments as a multi-tubular acoustic baffle; however, it should be noted that the components are easily configured into a variety of forms which, with appropriate connectors, allow efficient sound absorbing baffles to be placed near sound sources in many different physical arrangements including, but not limited to, most workstations or office desk uses. It is anticipated that a system of parts derived from the basis structural elements will be used to hold tubular absorptive material in such fashion that a useful sound absorptive shield is formed to reduce unwanted sound intrusion and enhance acoustic privacy.

Figure 1:
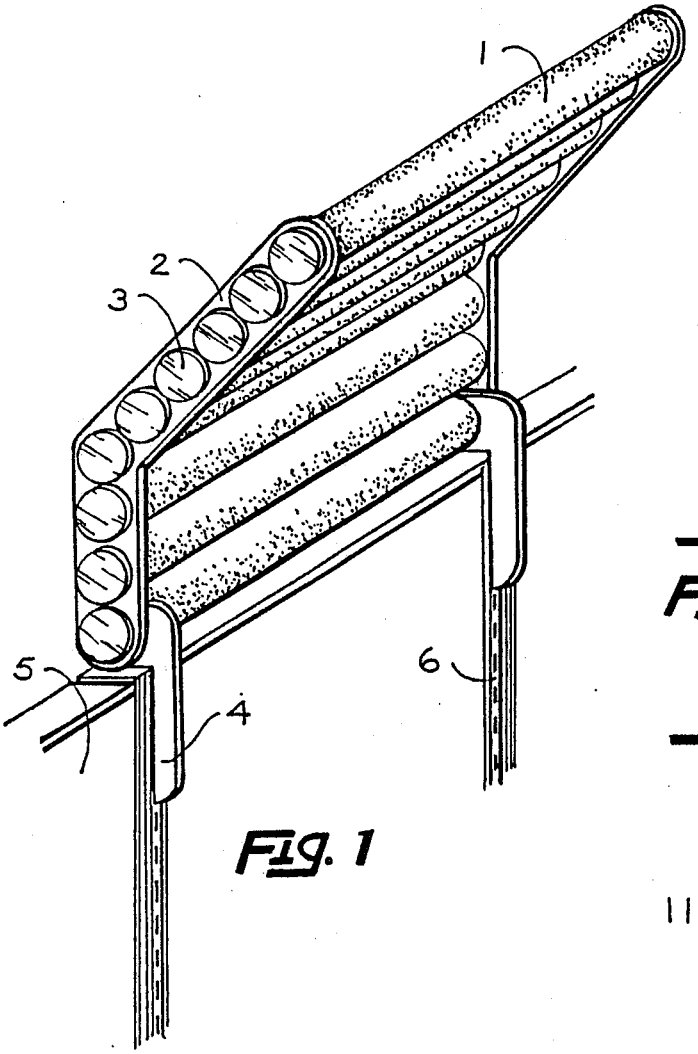
FIG. 1 is a perspective view of a multi-tubular acoustic baffle in its preferred embodiment, mounted with special brackets to the top of a typical manufactured workstation partition via embedded slotted standards in the partition.
Figure 2:
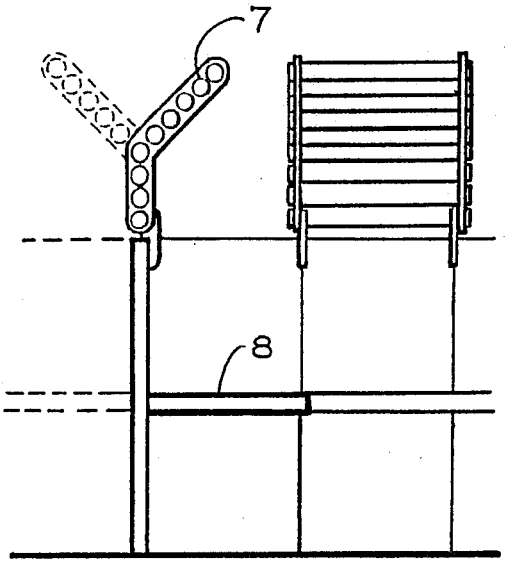
FIG. 2 is a combined side view and front view of a form of the device designed to service workstations on either side of the same partition simultaneously.

In the present invention, FIG. 1, numeral one (1) indicates a single typical tubular sound absorber, one of an array as shown. A plurality of these tubes, which are made from a suitable, sound-absorbent, flexible urethane foam or other extrudable or formable material capable of sound absorption, are held in place to an angled, planar array by a structural side piece (2) and fastening means (3) characterized by a bushing with integral end cap which is inserted through the side piece and into the tubular absorber element. The entire baffle assembly is attached as a unit by a bracket (4) to a position atop a workstation partition (5) inserted into the slotted track (6) used in virtually every manufactured partition system. The result is a structurally sound, light weight baffle which shields and absorbs sound emanating from, or impinging on, the workstation. This effect is illustrated in FIG. 2 where two baffles are shown mounted atop the partition enclosure. A workstation user seated at the workstation desk top (8) is partially shielded by the angled form and arrangement of the multi-tubular baffles. Since the baffles are modular, they may be matched to partition width dimensions and used singly or in combination. The structural side piece (7) is a basic element in the system which may be modified to serve users on either side of a common partition. This is achieved by adding an additional leg to the standard angled structural support (dotted line in FIG. 2) or by providing a separate Y-shaped structural side piece.

Figure 3:
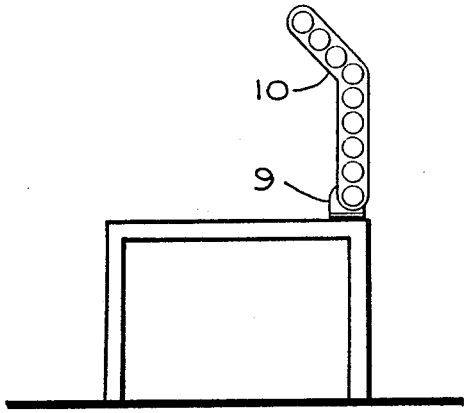
FIG. 3 shows a side view of a multi-tubular acoustic baffle mounted to the edge of a free standing, ordinary desk top.

In FIG. 3, the preferred embodiment of the device is shown mounted to a free standing table top surface and in this usage, the assymetric structural side piece (10) is inverted creating a taller profile where the longer leg is vertical, making for a more useful disposition of the device relative to a seated user and furnishing a degree of acoustic privacy to a user who is not otherwise surrounded by a workstation enclosure. A variety of hardware (9) is provided for temporary or permanent mounting of the invention to desk top surface or edge. This modified use of the device is also effective for alternating sound intrusion by desk top devices characterized by typewriters or computer printers.

Figure 4:
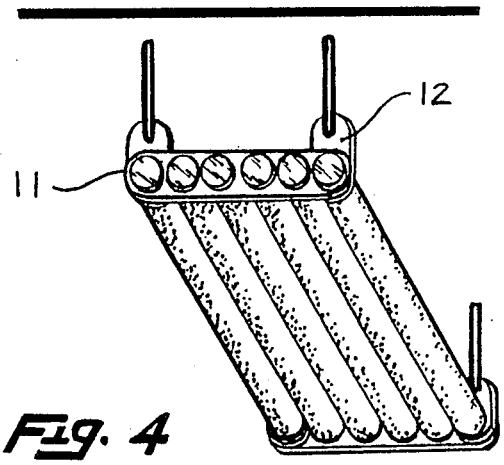
FIG. 4 is a perspective of a ceiling-suspended form of the device.
Figure 5:
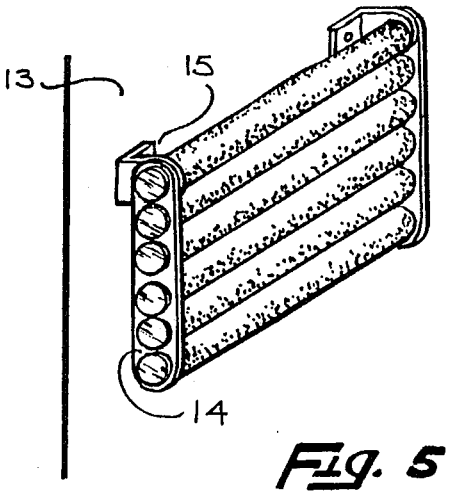
FIG. 5 is a perspective of a wall hung form of the device.

In FIG. 4 another modification of the device is disclosed. Straight structural side pieces (11) may be used to configure a flat planar arrangement of tubular absorptive elements which may be suspended from the ceiling above a workspace or sound souce with hanger elements (12). Likewise, refering to FIG. 5, a wall mounted panel is shown. Straight structural side pieces (14) or angled structural side pieces may be used, and the entire assembly is hung via brackets (15) to any wall surface (13).

Figure 6:
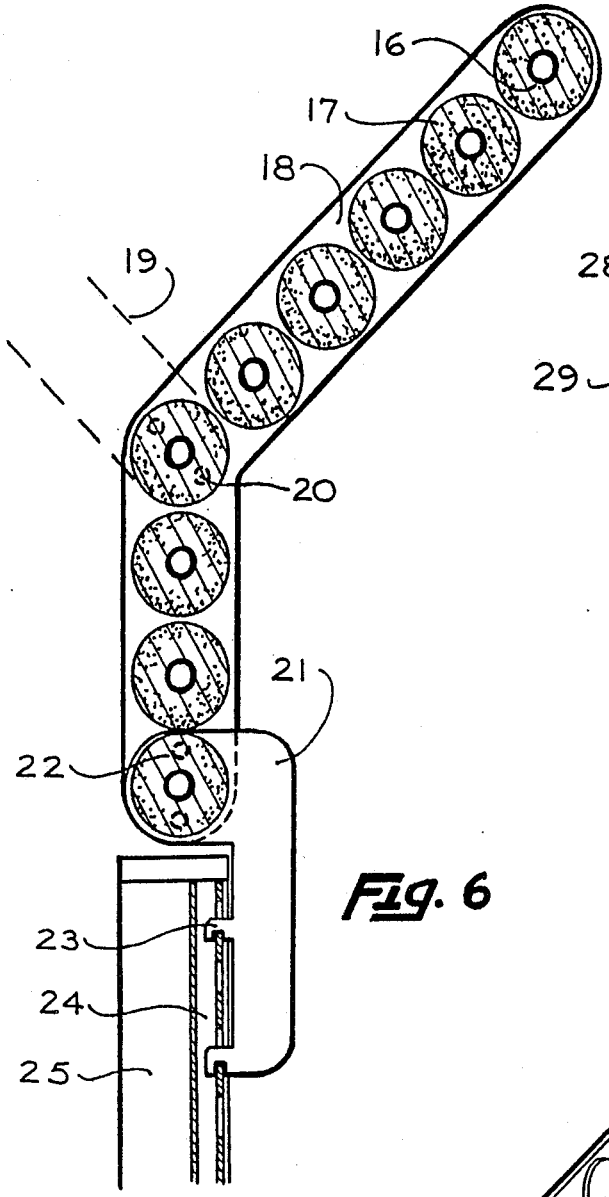
FIG. 6 is a sectional view of the preferred embodiment with typical hardware and method of attachment shown.

The multi-tubular, acoustic baffle assembly is illustrated in complete cross-section in FIG. 6. The arrangement of a multiplicity of stiffening cores (16) and tubular absorbers (17) is clearly shown creating a bent plane with continuously scalloped surface which becomes an efficient sound absorbent assembly with total exposed surface area equal to approximately 1.57 times the area of an equivalent flat element of substantially similar linear dimensions. The angled structural side piece (18) of the preferred embodiment is shown in profile and connected to a special panel bracket (21) with screws or like fasteners at 2 points (22). The panel bracket (21) has typical notched projections (23) of the type normally used to attach office partition system accessories to the partitions themselves (25). The spacing of notched projections can be made to correspond to the spacing of slotted track (24) dimensions. Numeral 9 shows the location of an additional structural element, when used, attached at 2 points by screws on the like (20).

Figure 7:
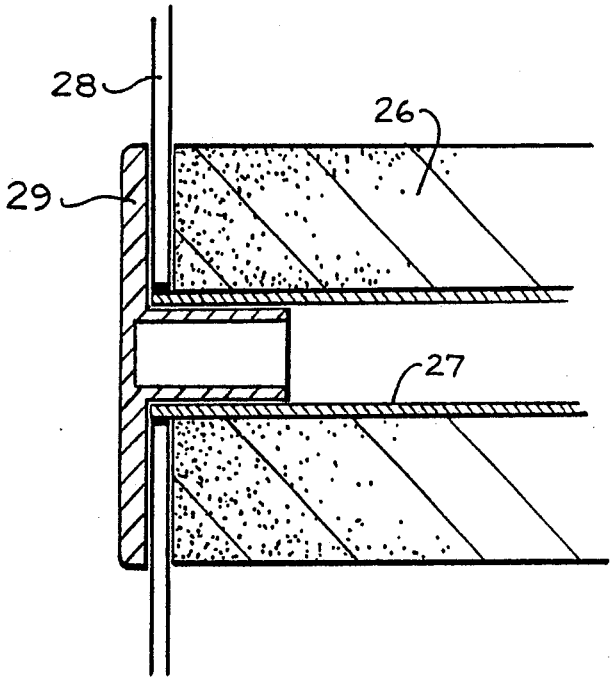
FIG. 7 is a detail section through a portion of the device.

FIG. 7 is a detail of the components in the device. The acoustic tubular element (26) is fabricated from suitable sound absorbent material characterized by flexible, open-cell urethane of reasonable density, and in a variety of modular lengths. The circular cross section of the tubular element presents a curved face to sound absorbency of greater length than a flat face.

This desirable aspect produces an increase of 57% ($3.1416 \times \frac{1}{2}$) of exposed absorptive surface area over an equivalent segment of flat surface. A hollow tube of lightweight, rigid material (27) is inserted into the tubular absorber as a stiffening core and as an aid to the absorbtion of lower frequency sound. The combination of flexible absorptive material with a rigid stiffening element has been shown to widen the frequency spectrum over which attenuation may occur. A flat, rigid, structural side piece (28) supports a multiplicity of absorbing tubes, which are fastened in place via fastening means characterized by a bushing with integral end cap (29).

Figure 8:
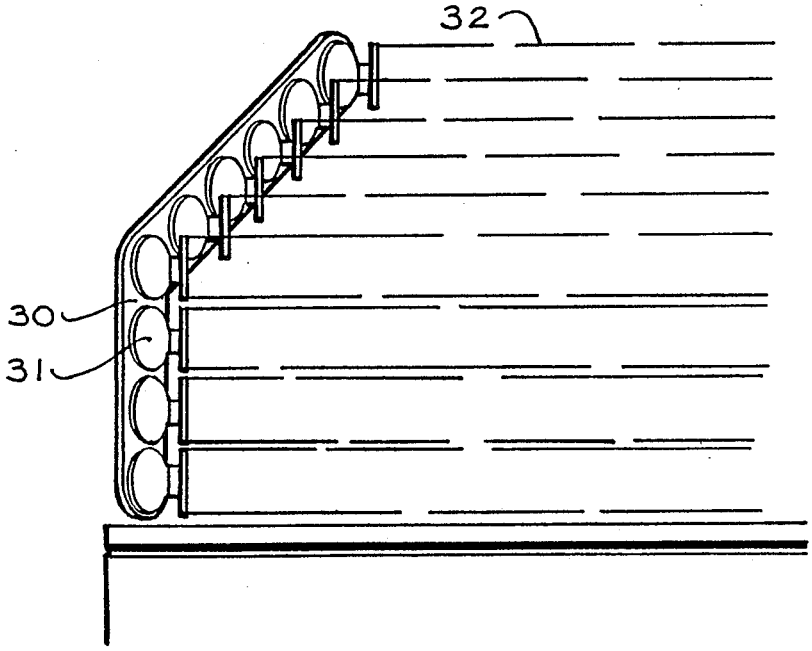
FIG. 8 is a side view of a structural support element for joining 2 corner absorber assemblies.

Finally FIG. 8 illustrates a special structural member which produces a 90 degree corner transition through the use of integral brackets angled, for each tubular absorber, at 45 degrees to the longitudinal axis of each of said tubular absorbers. This structural piece is used when full acoustic baffling of a partitioned workspace is desired.

Disclosure of the invention herein described represents preferred embodiments of the device with specific modifications; however, further variations thereof in form and construction are possible within the scope of the claims which follow:

1. A multi-tubular acoustic baffle system forming a partial enclosure including:
   (a) a plurality of tubular elements made from acoustically absorbent material
   (b) support means extending along a longitudinal axis for holding the plurality of tubular absorbing elements firmly in place in a substantially axially parallel and co-planar arrangement and with the support means angled along the longitudinal axis to produce a bend at an obtuse angle so that the form of a single multi-tubular acoustic baffle unit takes on a bent planar shape, such that the overall shape resembles a partial enclosure
   (c) fastening means for anchoring the plurality of tubular absorbing elements firmly but non-permanently to the support means, and
   (d) an attachement means for attaching one or more assembled multi-tubular acoustic absorber units to an environmental enclosure surface characterized by ceiling, wall, or free standing partition.

2. A multi-tubular acoustic baffle system as recited in claim 1, where the tubular elements are made from flexible, sound absorbing urethane foam material with a thin-walled, rigid tubular stiffening core, co-axially inserted to enhance sound absorption at lower frequencies.

3. A multi-tubular acoustic baffle system as recited in claim 2 for use with manufactured office workstation partitions having particular modular dimensions and including slotted channels in which the tubular elements and stiffening core are cut to lengths to correspond to the modular dimensions of the manufactured office workstation partitions and where the attachment means provide firm but temporary anchorage to the slotted channels which are included with said workstation partitions.

4. A multi-tubular acoustic baffle system as recited in claim 3 in which the fastening and attachment means permit both rapid assembly and disassembly whether for shipping, storage or relocation of individual acoustic baffle units and installation in place, or removal of multiplicity of baffle units by unskilled users.

5. A multi-tubular acoustic baffle system as recited in claim 3 provided with attachment means, such as a clamp, for temporary mounting to horizontal surfaces characterized by a desk top and vertical surfaces charactarized by free standing partitions so that the integrity of these surfaces are not in any way permanently altered, marred, or drilled for screws, and so that rapid installation and removal of numerous baffle units may be accomplished by unskilled personel without the use of tools.

* * * * *